United States Patent [19]

Fly

[11] Patent Number: 5,009,041

[45] Date of Patent: Apr. 23, 1991

[54] WEIGHTED MEMBRANE STRUCTURES

[75] Inventor: Anderson B. Fly, Amarillo, Tex.

[73] Assignee: Fly Enterprises, Inc., Amarillo, Tex.

[21] Appl. No.: 404,879

[22] Filed: Aug. 3, 1982

[51] Int. Cl.[5] ..... E04G 11/04; E02D 29/00

[52] U.S. Cl. ..... 52/2.19; 405/60; 405/203; 405/210; 135/119; 47/17

[58] Field of Search ..... 52/2, 2 C, 2 H, 2 I, 52/2 J, 2 K, 2 N, 2 P; 135/120, 119, DIG. 9; 47/17; 5/457; 405/64–66, 68, 205, 210, 224, 60, ; 114/257

[56] References Cited

U.S. PATENT DOCUMENTS

| | | | |
|---|---|---|---|
| 2,749,592 | 6/1956 | Vartia | 52/745 |
| 2,812,769 | 11/1957 | Schaefer | 52/2 F |
| 3,225,413 | 12/1965 | Bird et al. | 52/2 |
| 3,373,531 | 3/1968 | Meyer | 52/2 P |
| 3,389,510 | 6/1968 | Stock | 47/17 |
| 3,851,487 | 12/1974 | Lambertsen | 114/257 |
| 4,002,707 | 1/1977 | Oram | 52/2 J |
| 4,099,351 | 7/1978 | Dalo et al. | 52/2 |
| 4,176,653 | 12/1979 | Pittman | 52/2 |
| 4,405,258 | 9/1983 | O'Rourke | 405/60 |

FOREIGN PATENT DOCUMENTS

| | | | |
|---|---|---|---|
| 655445 | 6/1929 | France | 52/2 |
| 1447043 | 8/1976 | United Kingdom | 135/120 |

OTHER PUBLICATIONS

"Storage Offshore? Put It in a Bag", Jun. 6, 1960, two pages, one marked p. 75.

*Primary Examiner*—Richard E. Chilcot, Jr.
*Assistant Examiner*—Deborah McGann Ripley
*Attorney, Agent, or Firm*—Wendell Coffee

[57] ABSTRACT

Weights in the form of water-filled flexible tubes are attached onto the pressure supported roof membrane of a building. The weights contour the membrane from a single dome into smaller elongated domes. The decreased radii of curvature of the smaller domes substantially reduce both the stress within the membrane and tension exerted by the membrane on the building walls.

6 Claims, 3 Drawing Sheets

WEIGHTED MEMBRANE STRUCTURES

CROSS REFERENCE TO RELATED APPLICATIONS

None, however, applicant filed Disclosure Document No. 095,969 on Dec. 1, 1980, Disclosure Document No. 100,795 on June 15, 1981, Disclosure Document No. 106,469 on Mar. 1, 1982, and Disclosure Document No. 106,593 on Mar. 5, 1982 which documents concern this application; therefore, by separate paper it is respectfully requested that the documents be retained and acknowledgement thereof made by the Examiner. (MoPEP 1706)

BACKGROUND OF THE INVENTION (1) Field of the Invention

This invention relates to pneumatic structures, and more particularly to such structures wherein a membrane is supported by fluid pressure thereunder.

(2) Description of the Prior Art

Before this application was filed, a search was made in the U.S. Patent and Trademark Office. That search developed the following U.S. Pat. Nos.:

| | |
|---|---|
| SUITS | 2,649,101 |
| LINGAFELTER | 2,920,846 |
| DEMARTEAU | 3,123,085 |
| NEUMARK | 3,169,542 |
| LAING | 3,249,682 |
| MEYER ET AL | 3,373,531 |
| CAPLAN | 3,475,915 |
| McCONNELL ET AL | 3,480,023 |
| SCHNEIDLER | 3,626,836 |
| SINOSKI | 3,740,902 |
| KOLIOMICHALIS | 3,747,131 |
| AMARANTOS | 3,999,333 |
| KWAKE | 4,004,380 |
| PITTMAN | 4,176,653 |

These patents are considered pertinent because the applicant believes the Examiner would consider anything returned by the searcher to be relevant and pertinent to the examination of this application. The applicant is also aware of the following specific reference on pneumatic structures (hereinafter referred to as Otto.): *Tensile Structures*, edited by Frei Otto, The MIT Press, Cambridge, Mass. (1973); Library of Congress catalog card number: 73-3123. Applicant believes that The MIT Press has published an updated version of this reference, although applicant is unaware of its contents or identity.

In the pneumatic structure to which this invention relates, a membrane is connected at its periphery to a foundation. Otto calls the pliant covering a membrane and so will applicant, meaning by this term a fluid-tight, flexible sheet of material which separates the fluid above from the fluid below. It will be understood the foundation may or may not include walls and other superstructures, as desired, the term foundation being defined as structure connecting the membrane periphery to the ground to form a substantially fluid-tight enclosure. The term "periphery" refers to the boundary of the membrane, where the membrane is connected to the foundation or a rigid structural part thereof, such that substantial movement of the membrane at the point of connection is prevented. The membrane is supported by an internal fluid pressure greater than the external fluid pressure. This pressure differential exerts a uniform force on the membrane surface, which causes the membrane to assume a dome shape. The term "dome" means that at least one area of the membrane is elevated above other areas of the membrane. According to Otto, pages 10–17, the cross-section of the dome will be arcuate, approximating a segment of a circle, because this shape results in the least membrane stress.

For illustrative purposes, the shape of the dome of this application will be assumed herein to be a longitudinal section of a cylinder, similar to that schematically represented in FIG. 8, although it will be understood that the fundamental principles illustrated herein apply to any other membrane shape. Referring to FIG. 9, the arcuate cross-section of the dome taken perpendicularly to the axis of the cylinder has a curvature c,1 and a radius of curvature r,1. Otto, pages 70–77 reveals that the tangential stress within the membrane at any point on the arcuate cross-section will be approximated by the function: $s=(p)\times(r)$, where: s=tangential stress at any point on the membrane; p=differential pressure=internal fluid pressure-external fluid pressure; r=radius of curvature of the arcuate cross-section. As the radius of curvature increases, the stress increases. This relationship between stress, radius of curvature and pressure differential holds true for other membrane shapes, although the function describing the relation of r and p to s may vary for different membrane shapes (Otto, pages 10–17, 78–109).

Recalling the formula $s=(p)\times(r)$, for a given constant pressure (p) sufficient to support the membrane, the arcuate cross-section defined by the curvature c,1 and radius of curvature r,1 in FIG. 9, where r,1=½ the building width, is the arcuate cross-section having the least membrane stress, since r,1 represents the minimum possible radius for a single dome (Otto, p.31). The height of this dome is also ½ the building width. This dome has a large volume under the membrane, which requires much greater heating and cooling capacity than a conventionally constructed building or flatter membrane shape. The membrane height appears out of proportion to the building width. The surface of the dome could be more subject to deflection and oscillation by wind forces than a flatter membrane shape. The quantity of membrane fabric required is greater than for a flatter membrane shape.

Others have recognized the desirability of a flattened membrane. Some have used tension structures connecting points on the membrane with the ground or foundation to flatten the membrane. DEMARTEAU employs a net covering the membrane, with the net being secured to the walls and foundation by an elaborate network of tension cables. Similarly, NEUMARK employs tension cables connecting points on the membrane to the ground. MEYER ET AL pass a single tension cable over the membrane connected to the ground, as schematically shown in FIG. 9 by curvature c,2 radius r,2 and cables t. MEYER ET AL use a rigid tube to maintain a flat depression, since without the rigid tube the cable and membrane would define an arc. PITTMAN creates dimples in the membrane surface by connecting areas of the membrane to rigid ground supported frames. This prior art teaches the use of tension connections of the membrane surface to the ground or foundation to hold areas of the membrane down, i.e., to prevent areas of the membrane from going up. This prior art accomplishes several benefits in addition to flattening the membrane. Again referring to FIG. 9, it may be seen that several smaller domes may be created with tension cables t, shown as curvatures c,2 and radii of curvature r,2. The radius of curvature r,1, as taught by MEYER ET AL and substantially by NEUMARK, has been reduced to r,2 thereby reducing the membrane stress. Additionally, the tension exerted by the membrane on the foundation at the membrane periphery is reduced, and shared by the tension cables t connecting the depressed areas of the membrane to the ground or foundation.

Others, such as SINOSKI, have flattened the membrane by simply decreasing the membrane area, and thereby increasing the radius of curvature of the single membrane dome, as schematically reflected in FIG. (10). The increase from radius of curvature r,1 to r,3 results in a corresponding increase in membrane stress. SINOSKI employs expansion joints and extraordinarily strong membrane material, such as steel, to account for this increased membrane stress.

Although previous work in the art solved some problems in reducing membrane height and in some cases reducing membrane stress, several problems remained unsolved prior to this invention. FIG. 11 schematically shows the force exerted on a cylindrical membrane structure having the membrane periphery near the ground during wind conditions, where the length of the vectors indicates amount of force. The area of the membrane close to the ground will be subjected to substantial positive (+) wind loads. It is therefor necessary to maintain sufficient pressure differential (p) and therefor sufficient membrane stress (s) to resist deflection or buckling of the membrane near the ground. For example, a 60 mph surface wind will subject the lower membrane surface, or wall, of a building according to the MEYER ET AL and NEUMARK prior art to approximately 0.05 psi positive pressure. Therefore, a pressure differential of at least 0.05 psi would be necessary to prevent buckling of the membrane wall during a 60 mph wind.

Increased pressure to cure the above problem exacerbates another problem. The membrane area above the ground is simultaneously subjected to negative (−) wind loads. The prior art teaches that inflatable buildings must assume the maximum volume shape. No significant vertical movement of the membrane is permitted in the prior art design to expand the volume of the structure. Therefore, any negative pressure at the top of the membrane is transmitted directly to the fabric as lift, or vacuum, externally, while the internal pressure remains constant because the volume of the building is unchanged. The decreased external pressure at the roof top increases the pressure differential (p), at that area of the membrane, and hence increases the membrane stress (s). A prior art building with 0.05 psi differential pressure will have uniform stress throughout the membrane for the static case with no wind loads. For the 60 mph wind example, some areas of the membrane at the top of the building will be subjected to a negative pressure or vacuum of 0.15 psi as the wind passes over the building. The internal pressure differential of 0.05 psi is added to the negative pressure of 0.15 psi, and a total pressure differential of 0.20 psi is exerted on areas of the membrane during 60 mph winds. This is a fourfold increase in membrane stress from the static case. When the wind speed exceeds the speed at which the positive dynamic pressure exerted on the walls equals the differential pressure, (for the example, greater than 60 mph), the prior art building will indent at the leading edge near the ground, as shown in FIG. 11. This distortion will increase the internal pressure because the indentation lessens internal volume. The negative pressure, or vacuum at the top of the building will also be correspondingly greater for greater wind speeds, increasing differential pressure at some areas of the membrane manyfold and deforming the structure as further shown in FIG. 11. The fabric stress has now risen drastically. This stress increasing phenomenon is one primary design problem associated with the prior art.

If the membrane periphery is connected to the top of building walls as shown by SINOSKI, the walls will absorb some positive wind loads. However, the upper portions of the membrane will still be subjected to negative wind loads, with the attendant problems cited above, because the prior art designs do not permit significant upward movement of the membrane to adequately respond to wind load conditions.

Additionally, with the prior art, the membrane height, and the amount of fluid in the structure, could not be conveniently varied without substantially changing internal pressure. The cost, size, complexity and difficulty of installation and maintenance of cable systems increases with the area to be spanned. Internal cable systems might interfere with efficient use of the building.

SUMMARY OF THE INVENTION (1) New and Different Function

In this invention, a weight or weights are connected to the membrane to form small domes by depressing load areas of the membrane. The connections of the weights are such that the membrane and weights are able to move up and down responsive to changes in the fluid forces on the membrane.

This invention solves many problems addressed by the prior art with a different structure and method that is simpler, yet more versatile. This invention solves existing problems and makes feasible new applications of membrane structures not previously anticipated.

Pneumatic structures, hereinafter referred to as "membrane structures", have been primarily used as inexpensive, easily erected and transported temporary "tents". In those instances where membrane structures have been designed as permanent structures, (e.g., sports stadiums, warehouses) they have included walls. Therefore the illustrations that follow employ structures synergistically combined with walls.

Unlike the prior art, this invention contours the membrane into small domes having decreased radii of curvature, without tension connections of the membrane to the foundation or ground. As opposed to elaborate, complicated cable systems that require skilled installation or maintenance, this invention uses simple weights to form the domes. The preferred embodiment of a weight is a container in the form of a flexible tube of membrane material filled with flowable matter, such as water. Flowable matter is a liquid, or a solid pourable into and out of the containers. The invention uses available, inexpensive materials, such as water, compared to the relatively expensive tension cables. The installation of the invention requires filling the tubes with water. Installation of the prior art structure requires implanting anchors, connecting cables, and adjusting and maintaining the cables for the proper tension. In some circumstances, the prior art installation may not even be feasible, such as on the sea bottom. Therefore, this invention accomplishes the result of the prior art structure with a novel and unique structure and method that is simpler and less expensive.

Yet, the invention accomplishes greater results and solves problems not addressed by the prior art. This invention allows changes in the amount of fluid within the structure without substantially changing internal fluid pressure or membrane stress because, unlike the prior art, the membrane is allowed to move up or down, responsive to changes in the differential fluid pressure. The term "amount of fluid within the structure" refers to the number of moles of the various compounds comprising the fluid, and therefore to the mass of the fluid within the structure. The membrane height varies continuously as the amount of internal supporting fluid is varied, with the pressure remaining substantially constant. Therefore, a height regulator according to this invention, maintains membrane height by varying the amount of internal fluid. As the membrane rises, the radius of curvature increases minimally, thereby resulting in an insubstantial increase in membrane stress.

Because the membrane is allowed to move up and down responsive to changes in the fluid forces on the membrane, the wind load problems previously discussed are reduced. As a negative load is placed on the upper areas of the membrane, and the differential pressure increases, the membrane and weights move up to increase volume, decrease internal pressure, and maintain the differential pressure needed to support the weight of the membrane and weights. Therefore, because the radius of curvature and differential pressure vary minimally during wind conditions, the membrane stress remains substantially constant. The inertial mass of the weights acts as dampers to reduce deflections and oscillations of the membrane induced by transient changes in fluid pressure caused by winds. The height regulator aids in this function.

This invention increases the applicability and utility of membrane structures. For example, this invention makes the underwater use of membrane structures feasible. One problem with the underwater use of membrane structures is that hydrostatic pressure varies directly with depth. The internal fluid pressure must exceed the hydrostatic pressure at the lowest point on the membrane, ordinarily the membrane periphery, to prevent buckling of the membrane at the periphery. The pressure differential at the membrane top will be related to the membrane height above the periphery. For example, using gas inside an underwater structure, the pressure differential for a membrane 10 feet high would be five times that of a membrane 2 feet high. Therefore, flattening of the membrane is indispensable in underwater applications.

Because the invention maintains a substantially constant internal pressure during variations in amount of internal fluid, as previously described, the required differential pressure is maintained during removal or introduction of stored fluids. Additionally, use of cables, or extremely strong materials might prove infeasible underwater whereas a weighted membrane may be easily installed on the ocean floor. Additionally, weights may be employed to seal the membrane to the foundation and to reduce seepage through the foundation, thereby obviating the need for a mechanical anchoring of the membrane periphery to the foundation.

Thus it may be seen that the function of the total combination far exceeds the sum of the functions of the individual elements, such as membrane fabric, foundation, weights, fluids, etc.

(2) Objects of the Invention

An object of this invention is to provide shelter.

Another object is to provide storage for fluids at the bottom of a liquid body.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate, maintain, and remove.

Still further objects of this invention are to accomplish the above with a method that is versatile, rapid, efficient, and inexpensive and that does not require highly skilled people to install, adjust, operate, maintain and remove.

The specific nature of the invention, as well as other objects, uses, and advantages thereof, will clearly appear from the following description and from the accompanying drawing, the different view of which are not scale drawings.

BRIEF DESCRIPTION OF THE DRAWINGS

FIG. 8 is a schematic representation of a hemicylindrical dome with arcuate cross-section according to the prior art.

FIG. 9 is a schematic representation of a cross-section view of a building having a single hemicylindrical dome contrasted with a building having multiple domes of smaller radii of curvature according to the prior art.

FIG. 10 is a schematic representation of a cross-section view of a building having a single hemicylindrical dome contrasted with a building having a single dome of larger radius of curvature according to the prior art.

FIG. 11 is a schematic representation of the wind forces acting upon a building according to the prior art.

DESCRIPTION OF THE PREFERRED EMBODIMENT

Figure 1:
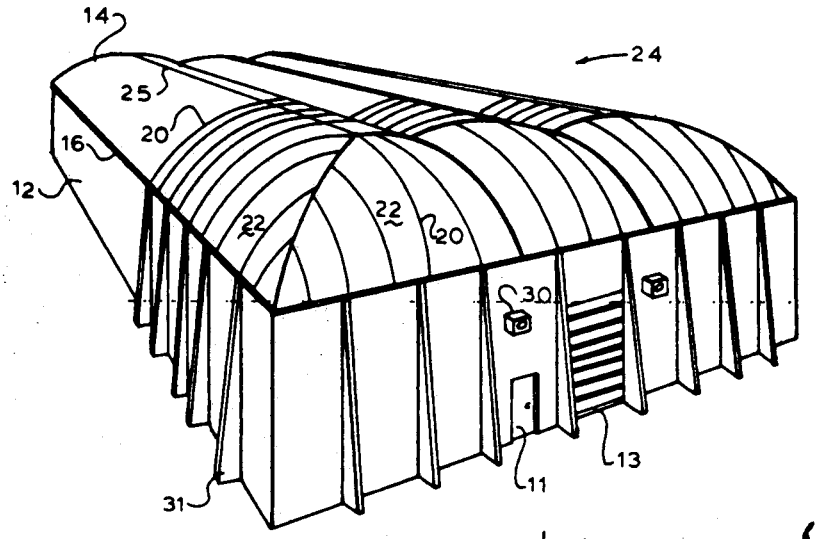
FIG. 1 is a perspective view of a membrane-covered building according to my invention.

FIGS. 1, 2, 3, 4, 5, and 6 disclose a structure in the form of a building having foundation 10 on the ground. The foundation includes straight, rigid walls 12. Doors 11 and 13 are located in one of the walls 12 as are windows (not shown). Membrane 14 is connected at its periphery 16 to the tops of the walls 12. The opposite walls 12 are parallel. The foundation and membrane 14 substantially enclose membrane interior 18. Membrane seams 20 join membrane fabric panels 22 to facilitate the formation of a desired shape as shown in FIG. 1, including somewhat hemicylindrical domes 24, with load areas 26 between the domes 24. Reinforcing straps 25 extend along the top of each dome 24. Weights 28 are connected at the load areas. The membrane 14 is supported by a positive pressure differential within the interior 18, wherein the internal fluid pressure is greater than the external fluid pressure, which is atmospheric. Blowers 30 continuously inject air into the interior 18, thereby accounting for any structural leaks, and maintaining the desired pressure differential.

Figure 2:
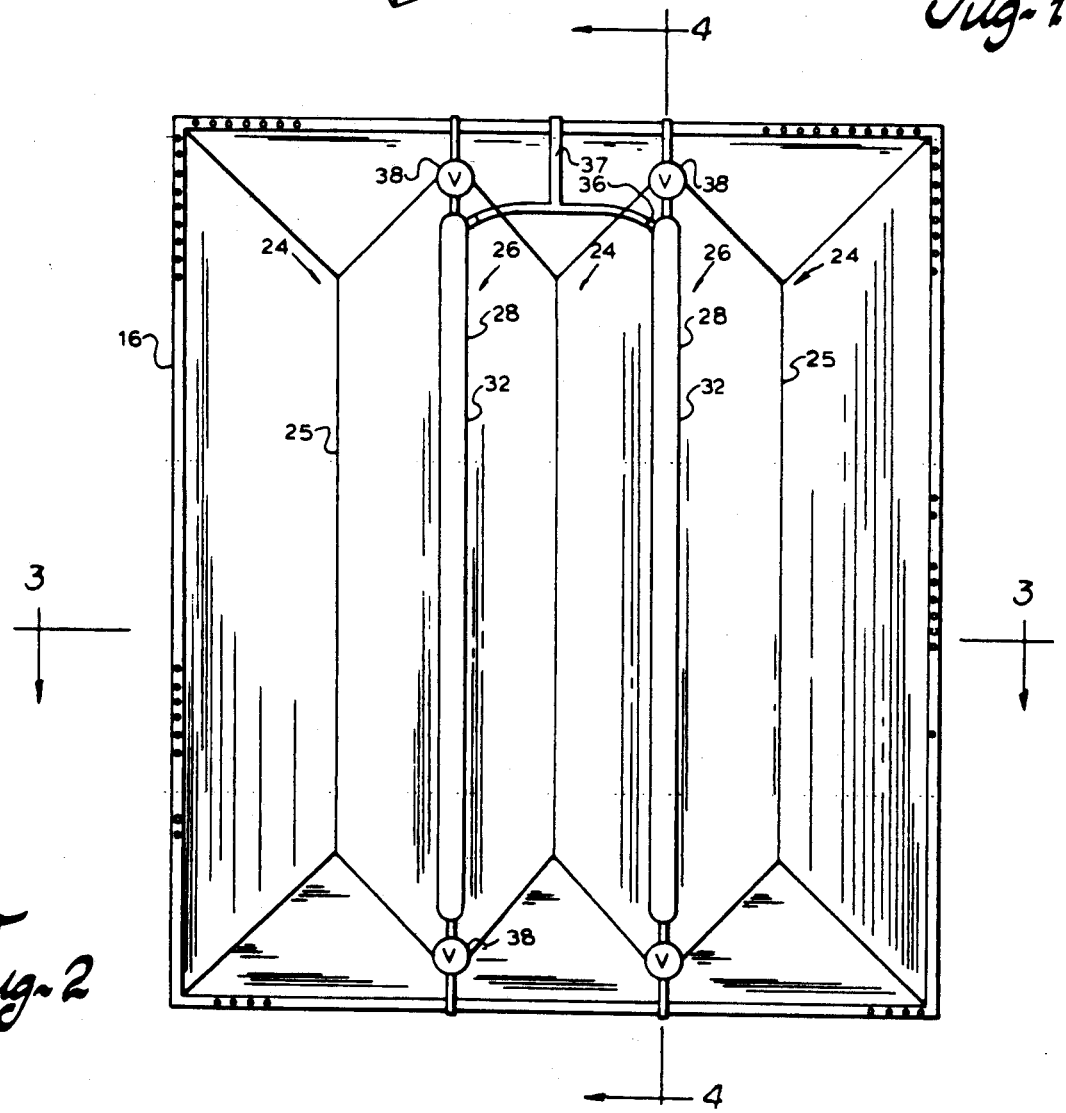
FIG. 2 is a top plan view of the roof of the building somewhat schematic.
Figure 3:
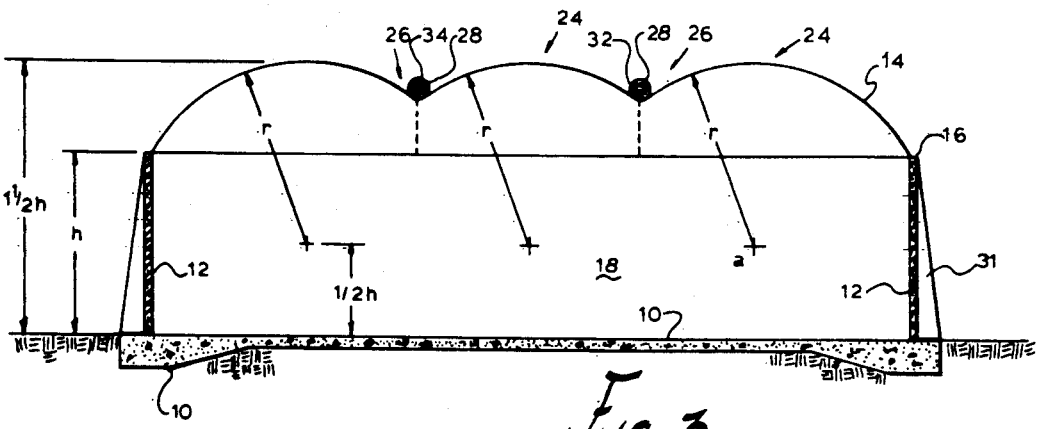
FIG. 3 is a schematic end sectional view of the building taken substantially on line 3—3 of FIG. 2.

I prefer to use precast, tiltup concrete walls 12 having pilasters 31 similar to those shown by VARTIA in U.S. Pat. No. 2,749,592, for strength, nonpermeability, and resistance to damage. The membrane fabric is preferably strong, lightweight fabric that has been treated to be substantially air and water-tight. The fabric used in other membrane structures having slight elasticity is acceptable. I prefer to place the membrane fabric in hoop stress rather than shear stress at the seams 20. The structure for placing the fabric in hoop stress and for connecting the membrane periphery 16 to the walls 12 is shown in FIGS. 1 and 2, and is well known in the art.

Figure 4:
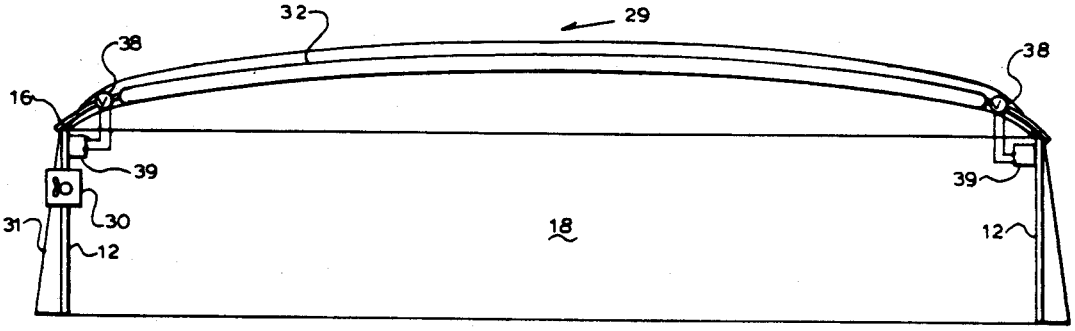
FIG. 4 is a schematic side sectional view of the building taken substantially on line 4—4 of FIG. 2.

The panels 20 are cut to dimensions and assembled such that at a design pressure just below the desired operating pressure, the domes 24 and load areas 26 will be horizontal. The building is then pressurized to the desired operating differential pressure, slightly above the design pressure. The operating pressure is maintained by a membrane height control mans described later. The increased pressure will from crest 29 mediate the load areas 26 as shown in FIG. 4. The crest 29 is desirable for roof drainage. The slope of the load areas 26 from the crest 29 to the ends of the load areas 26 has been exaggerated for illustrative purposes in FIG. 4. The rise, similar to irrigation ditches, of one foot vertical for each on e hundred feet horizontal will provide satisfactory drainage.

The weights 28 include containers in the form of flexible load tubes 32 filled with flowable matter in the form of water 34. I prefer to construct the load tubes 32 of the fabric used for the membrane, and to attach the load tubes 32 to the load areas 26 of the membrane 14 with disconnectable straps. The straps are not shown, since anyone skilled in the art could devise buckles, snaps or other structure to facilitate installation and removal of the load tubes 32 on the load areas 26. Each load tube 32 has fill means in the form of a spout 36 attached to the ends thereof. Ordinarily, the load tubes 32 must be completely filled and pressurized with the water 34. If the pressure within the tubes 32 is not greater than the difference in hydrostatic pressure along the tube 32 caused by different elevation of the load areas 26, the membrane 14 will form an arcuate cross-section along the load area 26 different than the desirable shallow crest 29.

Each spout 36 has a valve therein that may be closed during filling operations to insure that the load tube is completely full and adequately pressurized. The valve is not shown for the sake of clarity and brevity. Branched spout link 37 connects the spouts 36 to a threaded end extending conveniently to the periphery that can accommodate a garden hose (not shown) connected to a convenient water source for filling the load tubes 32.

Each load tube 32 has dump means in the form of electrically activated quick-release dump valves 38 attached to each end thereof. Solenoid controlled dump relay 39 is electrically connected to the dump valves 38 so that when a current is passed through the relay solenoid the valves 38 open to quickly dump all water 34 in the tubes 32. The solenoid of the relay 39 is activated by dump trigger 40, which supplies current to the solenoid when the membrane drops below a minimum desired height, as described below.

In the event of an emergency (i.e., when the blowers 30 fail, the membrane 14 suffers a large puncture, or a door 13 or window in the wall 12 breaks) such that pressure differential sufficient to support the membrane 14 and weights 28 can no longer be maintained, the dump valves 38 would all be triggered to dump all of the water 34 from the load tubes 32. After the water 34 is dumped, a lower internal pressure will support the membrane 14 until appropriate repairs are completed to restore operating internal pressure. If internal pressure is not available to support the membrane 14 alone, the absence of the weights 28 on the membrane 14 as it settles onto any property in the interior 18 will reduce damages to the property and the membrane 14.

I prefer to use an automatically activated trigger 40 because an emergency could develop while no persons are present at the building and human reaction would probably not be quick enough to dump the water in time anyway. The dump valves 38 may include any means of quickly opening the ends of the load tubes 32 including knives that cut open the tube fabric or other means of opening the ends of the tubes 32. The dump valves 38 should discharge the water outside the periphery 16, so that the water will not collect in the depression formed by the membrane if it settles down inside the building.

Figure 5:
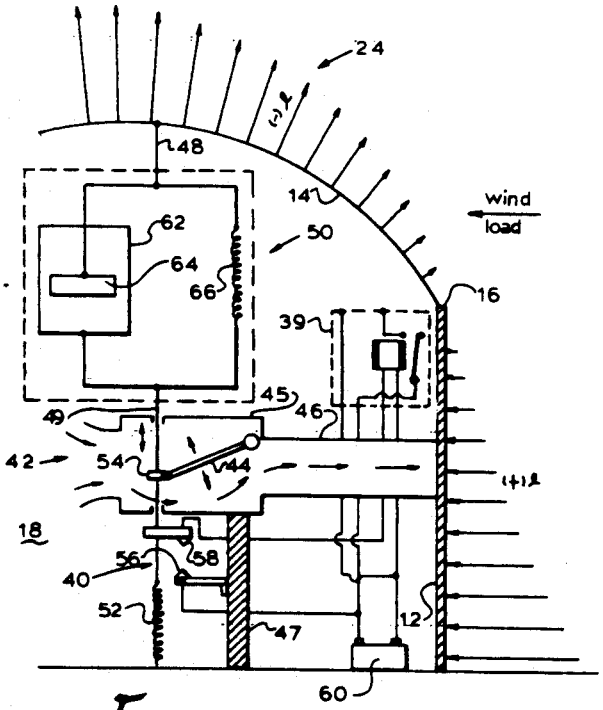
FIG. 5 is a schematic representation of a height regulator according to my invention with external wind forces on the building of FIG. 3.

Mechanical analog height control means in the form of height regulator 42 is schematically shown in FIG. 5. It will be understood that anyone with ordinary skill in electronic design could easily provide an electronic height control means based on the illustrative mechanical analog mans. The height regulator 42 includes outlet valve 44. Housing 45 of the valve 44 is attached at the end of outlet duct 46. The housing 45 is supported by housing support 47. The valve 44 provides a means for venting air from the interior 18 at a variable rate. Membrane sensor strap 48 is connected at top end to the membrane. Sensor cable 49 is connected to the lower end of the sensor strap 48 by acceleration damper 50. The bottom end of the sensor cable 49 is connected to the ground by tension spring 52, which keeps the sensor cable 49 and sensor strap 48 taunt but exerts insubstantial downward force on the membrane 14. The outlet valve 44 is connected to the sensor cable 49 by clamp 54. The clamp 54 is fixably adjustable along the sensor cable 49, and provides means for selecting the membrane height.

The clamp 54 also serves as the means for calibrating the height control means to maintain the operating pressure sufficient to form the crest 29. At the design differential pressure previously discussed, the load areas and domes will be horizontal. The design pressure will be just sufficient to support the membrane 14 and weights 28. From the design position, the clamp 54 is adjusted along the sensor cable 49 to slightly decrease the rate of venting, hence increasing the differential pressure a small amount necessary to form the crest 29. The clamp 54 is secured to the sensor cable when the desired crest 29 height is reached. Any further decrease in the rate of venting will increase the differential pressure above the operating pressure needed to support the membrane 14 and weights 28 and form the crest 29, and cause the membrane 14 and weights 28 to rise.

The mechanical analog height control means actuator of the dump trigger 40 includes stationary contact 56 and trigger contact 58. The stationary contact 56 is rigidly attached to the housing support 47 proximate the sensor cable 49 and electrically connected to a source of power 60. The trigger contact 58 is attached adjustably along the sensor cable 49 above the stationary contact 56, and is electrically connected to the solenoid of the dump relay 39, such that when the contacts 56 and 58 meet, an electric current is passed through the relay 39, actuating the dump valves 38 as described above. The trigger contact 58 is adjusted along the sensor cable 49 to a position such that the contacts 58 and 56 will meet when the membrane 14 drops to a selected minimum level. A manual bypass may be provided.

As the membrane 14 rises, responsive to forces above the membrane, the sensor strap 48 connected to the membrane causes the outlet valve 44 to open to vent air in the interior 18 at a greater rate, thereby continually decreasing the amount of air in the interior 18, reducing internal pressure, decreasing differential pressure, and lowering the membrane 14. Conversely, as the membrane 14 lowers, the sensor cable 49 closes the outlet valve 44, venting air from the interior 18 at a lesser rate, thereby continuously increasing the amount of air in the interior 18, increasing internal pressure, increasing differential pressure, and raising the membrane 14 to the selected height. No changes in the operating characteristics of the valve 44 or blower 30 are needed as the selected membrane height changes, since with this invention, the internal pressure variance is insubstantial relative to changes in membrane height.

The acceleration damper 50 includes dashpot 62 with dashpot piston 64 slidably positioned therein connected in parallel with acceleration spring 66. The dashpot piston 64 is sized such that air within the dashpot 62 can escape past the piston 64 at a maximum predetermined rate during movement of the piston 64.

The acceleration damper 50 produces a rapid opening of the outlet valve 44 during extremely sudden gusts of wind and rapid upward movement of the roof membrane 14 because the air cannot escape past the dashpot piston 64 fast enough to prevent complete opening of the outlet valve 44. Slower upward movement of the membrane allows the air to bleed around the dashpot piston 64 causing the acceleration spring 66 to stretch and slow down the opening of the outlet valve 44. The frequency of response of the damping action is so much slower than the frequency of response of the roof membrane 14 that any possibility of additive responses is virtually eliminated.

This invention accounts automatically for the presence of live loads on the membrane in the form of snow or ice, since additional weight would require an increase in differential pressure. As the live load is placed on the membrane, the height regulator 42 will vent internal air at a decreased rate, increasing interior pressure and thereby increasing the differential pressure to that required to support the additional live weight.

Figure 6:
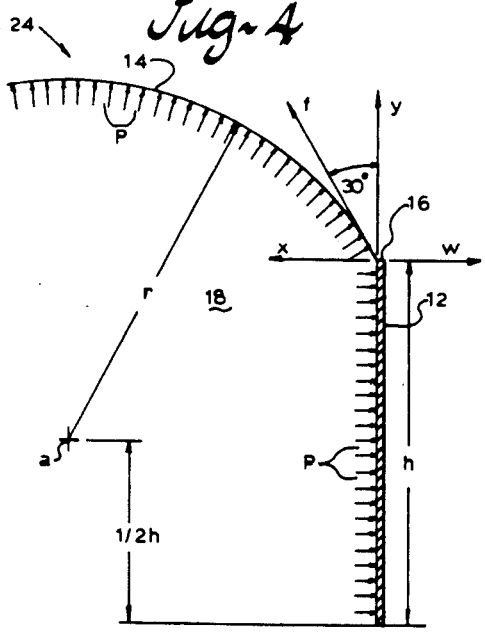
FIG. 6 is a schematic representation of the internal pressure forces exerted on the wall of the building of FIG. 3.

Referring to FIG. 6, I prefer to determine the shape of the domes 24, the location of the load areas 26, the mass of the weight 28 and the height of the walls 12 above the ground such that at a desired membrane height, the radius of curvature (r) of the domes 24 will be approximately equal to the height (h) of the walls 12, and the axis of curvature (a) will be at a height ($\frac{1}{2}$h) approximately equal to one-half the height (h) of the wall 12. I also prefer to space the axes of curvature (a) apart a distance approximately equal to 130% of the wall height (h) to insure maximum dynamic stability regardless of the direction of the wind. With this design the tangent of membrane 14 at the periphery 16 forms a 30° angle with a vertical line extended from the top of the wall. The tensile force exerted by the membrane 14 on the wall 12 therefore acts at a 30° angle, shown by the vector (f) in FIG. 6. The vector (f), when separated into its horizontal component vector (x), and vertical component vector (y), may be seen to result in a horizontal force (x) equal to the sine of 30° times the membrane stress at the periphery, or $\frac{1}{2}\times r\times p$, toward the interior of the structure. The force resulting at the top of the wall 12 from the action of the pressure differential (p) on the wall 12 (shown by vector (w) in FIG. 6), is the height of wall (h) times pressure differential (p) divided by two. Inasmuch as the radius of curvature (r) is equal to the wall height (h), the horizontal force (w) resulting toward the exterior of the structure at the wall top is $(r\times p)/2$. Therefore, this dome shape results in a balance of membrane and air pressure forces on the wall to reduce wall stress. Stated otherwise, the two horizontal forces (x) and (w) apply opposing forces to the top of the wall, such that the moment applied to the wall by the membrane is approximately equal to the moment applied to the wall by the pressure differential acting on the wall.

The installation of this embodiment of my invention may be seen to preferably occur as follows. The foundation 10 including tiltup concrete walls 12 are constructed, with blowers 30 in the walls 12. The membrane periphery 16 is connected as previously described to the tops of the walls 12. The quick release dump valves 38, spouts 36, and load tubes 32 are already attached to the membrane 14. The height regulator 42 is located in the structure with the sensor strap 48 connected to the membrane 14 and spring 52 connected to the ground. The dump relay 39 and dump trigger 40 are attached to the wall 12 and height regulator 42, respectively. For most buildings a garden hose is connected to each spout 36, and the load tubes 32 filled with water 34 from a convenient source. After the load tubes 32 are filled, the blowers 30 are activated, with the outlet valve 44 in the closed position. As the internal pressure increases to that sufficient to support the membrane 14 and weights 28, the membrane rises. The membrane height is selected on the height regulator 42, the trigger contact 58 is positioned on the sensor cable 49 for minimum height, and the building is ready for use.

Stress in membrane 14 forces applied to the top of the walls 12 at the moment the load tubes 32 rise above the floor must be calculated for each building to insure that excessive stresses will not be developed. Stress levels can be reduced by increasing the overall length of the membrane 14, by positioning the axis of curvature (a) slightly above $\frac{1}{2}$ the height of the walls 12 or spacing the axes of curvature (a) further apart. The extra length of the membrane 14 reduces the stress levels by decreasing the radius of curvature (r) of the domes 24 at the instant the load tubes 32 are lifted clear of the floor. Alternatively, if the axes of curvature (a) are as shown in this embodiment, load tubes 32 can be filled with water after the membrane 14 has been lifted by air pressure to a position selected on the height regulator 42 below the normal operating level. Water would flow to the center of the load tubes 14, during fillings thus obtaining a stable configuration. Air pressure will be gradually increased by the height regulator 42 to support the additional weight as the load tubes 32 are filled with water. After the load tubes 32 are appropriately pressurized, the height regulator 42 is calibrated to produce the crest 29, and the building is ready for use.

Referring to FIG. 5, the operation of this embodiment of the invention during windy conditions is substantially as follows. The wind exerts positive loads [(+)1] on the walls 12, and exerts negative loads [(−)1] on the membrane 14. If the wind gusts are not extremely sudden, the membrane 14 rises, and through the action of acceleration spring 50, the height regulator 42 will sense a rapid increase in membrane height, and decrease the internal pressure by exhausting internal air at a greater rate. If the wind gusts are extremely sudden, the height regulator 42 will act through the dashpot 62 and piston 64 to more quickly adjust internal pressure, causing increased damping of membrane deflections and oscillations by the height regulator 42. The amplitude of the initial rising of the membrane 14 will also be lessened by the inertia of the water 34 in the tubes 32. Analysis will show that the weights 28 will move horizontally as well as vertically during wind gusts.

This invention makes buildings of large free span, e.g., a width of 1,000 feet, economically feasible because the pressure required to support the membrane 14 with numerous domes 24 and weights 28 varies little, if any, as the width of the building is increased.

The building illustrated is the preferred embodiment of my invention applied to a conventional building. The potential applications of this invention are not restricted to the building described herein, nor to structures having rigid walls. For instance, by employing transparent membrane fabric, the building may easily be adapted for use as a greenhouse.

The broad applicability of this invention is illustrated by a second preferred embodiment for storing fluids underwater, which may also be adapted to provide a dry shelter for people and property at the bottom of a body of water.

Figure 7:
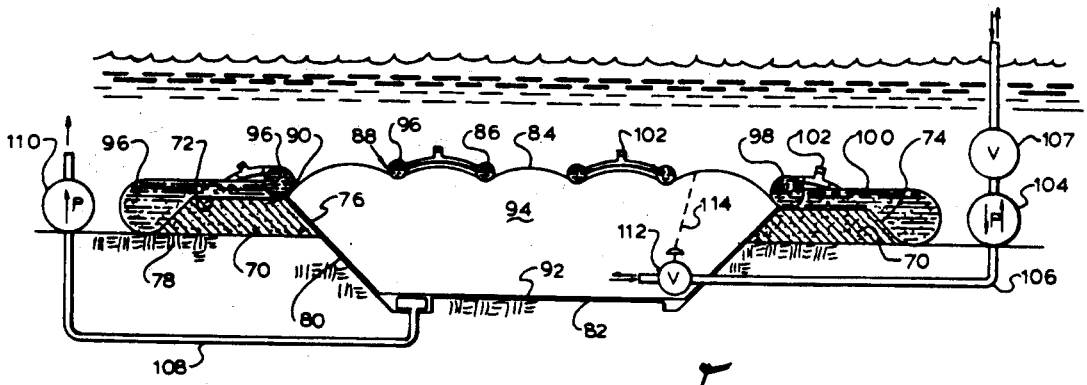
FIG. 7 is a side sectional view of an underwater fluid storage structure according to my invention.
Figure 8:
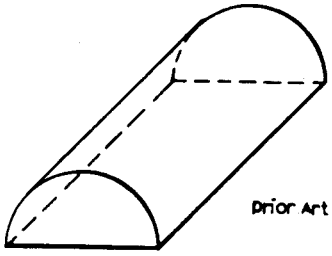
FIGS. 8, 9, 10, and 11 illustrate the prior art, specifically.
Figure 10:
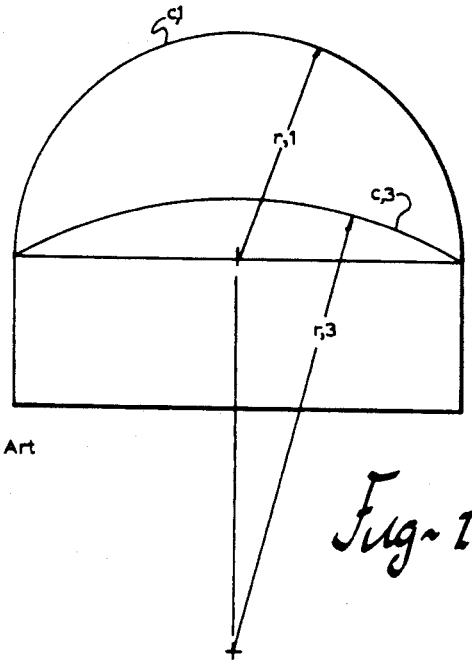
Figure 9:
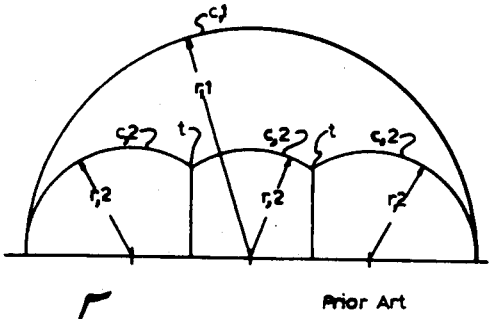
Figure 11:
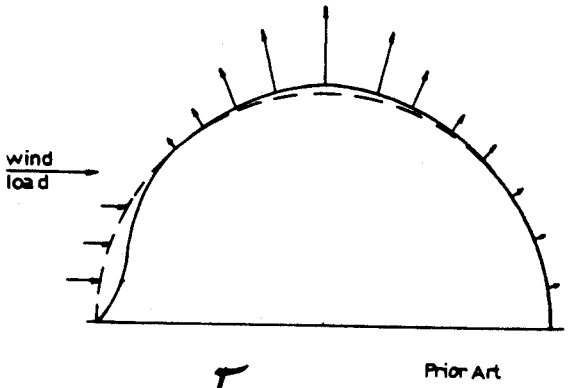

FIG. 7 shows a section of an embodiment of my invention for storing fluids at the bottom of a body of liquid. This embodiment assumes that natural gas is to be stored at the bottom of the sea. Foundation 70 forms a wall having an elevated surface 72, an outer slope 74 and an inner slope 76 above sea bottom 78. The foundation 70 surrounds an excavated or naturally occurring depression of of the sea bottom 78, having sides 80 and floor 82. Membrane 84, having containers in the form of flexible load tubes 86 removably connected onto load areas 88 thereupon, is flush at its periphery 90 with the elevated surface 72. Floor membrane 92 is connected to the periphery 90, and extends down inner slopes 76 and sides 80 and over the floor 82. The floor membrane 92 need not be made of material as strong as the membrane 84. The membrane 84 and floor membrane 92 enclose a storage chamber 94. Each load tube 86 is filled with a weight in the form of high density flowable matter, such as drilling mud 96.

Seal tube 98 removably is connected onto the periphery 90 of the membrane 84 and is filled with a seal weight in the form of high density, flowable matter, such as drilling mud 96. The seal tube 98 forces the periphery 90 of the membrane 84 against the elevated surface 72. Anti-buoyancy skirt 100 is removably connected to the periphery 90 outboard of the seal tube 98. The skirt 100 is filled with high density flowable matter such as drilling mud 96, and extends from the elevated surface 72 down the outer slope 74 to the sea bottom 78. The anti-buoyancy skirt 100 and seal tube 98 provide a seal weight necessary to negate the effects of buoyancy on the stored fluid and insure that the storage chamber 94 remains on the sea bottom 78. The anti-buoyancy skirt 100 also seals the foundation 70 from seepage through the foundation induced by increased hydrostatic pressure at depths lower than the periphery 90 of membrane 84. Each load tube 86, seal tube 98, and anti-buoyancy skirt 100 has located thereon at least one spout 102, which provides a means for filling the tubes 86 and 98 and skirt 100 with the drilling mud 96. I prefer to use a spout 102 with a connector commonly used on hoses for pumping drilling mud in the oil well drilling art.

Fluid transfer means in the form of transfer pump 104 and transfer line 106 provide for addition and withdrawal of stored fluid above the sea surface. The internal operating pressure must be greater than the hydrostatic pressure at the periphery 90 to prevent buckling or indentation of the membrane 84 at the periphery 90. The membrane shape and mass of weight on the load areas 88 should be designed to be as flat as feasible to minimize the effects of decreasing membrane external hydrostatic pressure at lesser sea depths, as explained in the Summary of the Invention section above.

Where the sea bottom 78 is permeable to seawater, seepage line 108 and seepage pump 110 provide pump means for expelling any seepage through the sea bottom 78 under the floor membrane 92. If seepage is not removed, hydrostatic pressure would eventually produce a buoyancy effect on the storage chamber 94 full of natural gas. Although a floor membrane 92 is not essential to the use of the invention underwater, if the floor membrane 92 is not used, with permeable sea bottom 78, the maintenance of the proper pressure becomes of additional importance. In addition to the requirement that the internal pressure be greater than the hydrostatic pressure at the periphery 90, if no floor membrane is employed with permeable sea bottom 78, the internal pressure should be less than the hydrostatic pressure at the sea bottom 78 to preclude seepage of expensive stored fluids through the sea bottom 78 to outside the foundation 70.

To preclude overfilling of the storage chamber 94 such that membrane height increases beyond allowable limits, a height limiter in the form of limit valve 112 is at the end of the transfer line 106 extending within the storage chamber 94. The limit valve 112 is connected to the membrane 84 by limit strap 114 which exerts insubstantial force on the membrane 84. The height limiter provides for closing the transfer valve 112 as the membrane 84 reaches a maximum allowable height.

For the limit valve 112, I prefer to employ a valve that when open permits flow in two directions, but when closed permits flow in only from the chamber 94, because the valve 112 is inaccessible. In this way, the valve 112 inside the storage chamber 94 operates automatically to control inflow and control valve 107 at the transfer pump 104 controls outflow.

The pump 104 and the control valve 107 need not be at the sea bottom as shown, but may be at another location along the transfer line 106, such as at a central pumping station at the surface of the sea. The pump could be on a gas tanker and be connected to the transfer line above the sea surface for transfer out of, or on an oil well platform for transfer into, the storage chamber 94.

The installation and operation of this embodiment of the invention is illustrated as follows. A depression is excavated from the sea bottom 78, and the foundation 70 is constructed with the excavated material. The seepage line 108, seepage pump 110, transfer line 106, transfer pump 104 are emplaced in the seabottom 78. The membrane 84 has the load tubes 86, floor membrane 92, seal tube 98, anti-buoyancy skirt 100, limit strap 114 and limit valve 112 already connected. The tubes 86 and 98 and skirt 100 are empty of high density fluid. The periphery 90 of the membrane 84 is located flush with the elevated surface of foundation 70 and the transfer line 106 connected to the limit valve 112. Drilling mud 965 is pumped into the seal tube 98 and anti-buoyancy skirt 100 through the spouts 102. Sea water remains trapped below the floor membrane 92. Drilling mud 96 is then also pumped into the load tubes 88, with the sea water under the floor membrane 92 supporting the weight. Natural gas is pumped to the storage chamber 94 through the transfer pump 104 and transfer line 106. As the storage chamber is pressurized to a pressure greater than external hydrostatic pressure exerted on the membrane, the seepage pump 110 is started to expell the water below the floor membrane 92. As the storage chamber 94 reaches maximum capacity, i.e., when the membrane 84 reaches its maximum allowable height, the sensor strap 114 closes the transfer valve 112 to cease input. When an ocean tanker is available, the natural gas is pumped through the transfer line 106 and transfer pump 104 out of the storage chamber 94.

Should it be desirable to relocate the storage structure, the natural gas is removed from the storage chamber 94, drilling mud 96 pumped from the load tubes 86, seal tube 98, and anti-buoyancy skirt 100, and the membrane with attachments lifted to the sea surface for transport and reinstallation.

The embodiments shown and described above are only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point of what an infringement of this patent would be, but are to enable the reader to make and use the invention.

As an aid to correlating the terms of the claims to the exemplary drawing, the following catalog of elements is provided:

| | | | |
|---|---|---|---|
| 10 | foundation | 39 | dump relays |
| 11 | door | 40 | dump trigger |
| 12 | walls | 42 | height regulator |
| 13 | door | 44 | outlet valve |
| 14 | membrane | 45 | valve housing |
| 16 | membrane periphery | 46 | outlet duct |
| 18 | membrane interior | 47 | housing support |
| 20 | membrane seams | 48 | membrane sensor strap |
| 22 | membrane fabric panels | 49 | membrane sensor cable |
| 24 | domes | 50 | accelerate damper |
| 25 | reinforcing strap | 52 | tension spring |
| 26 | load areas | 54 | clamp |
| 28 | weights | 56 | stationary contact |
| 29 | crest | 58 | trigger contact |
| 30 | blowers | 60 | power source |
| 31 | pilasters | 62 | acceleration dashpot |
| 32 | load tubes | 64 | acceleration piston |
| 34 | water | 66 | acceleration spring |
| 36 | spouts | 70 | foundation |
| 37 | spout link | 72 | elevated surface |
| 38 | dump valves | 74 | outer slope |
| 76 | inner slope | 108 | seepage line |
| 78 | sea bottom | 110 | seepage pump |
| 80 | sides | 112 | limit valve |
| 82 | floor | 114 | limit strap |

-continued

| | | | |
|---|---|---|---|
| 84 | membrane | p | internal pressure force |
| 86 | load tubes | c | curvature of dome |
| 88 | load areas | r | radius of curvature |
| 90 | periphery | a | axis of curvature |
| 92 | floor membrane | h | height of wall |
| 94 | storage chamber | w | pressure resulted on wall top |
| 96 | drilling mud | f | membrane tension on wall top |
| 98 | seal tubes | x | horizontal component of f |
| 100 | anti-bouyancy skirt | y | vertical componenet of f |
| 102 | spouts | 1 | windloads on structure surface |
| 104 | transfer pump | (−) | negative force |
| 106 | transfer line | (+) | positive force |
| 107 | control valve | | |

SUBJECT MATTER CLAIMED FOR PROTECTION

I claim as my invention:

1. A membrane covered permanent structure built on ground having a. a peripheral wall connected to b. a foundation on the ground, c. a flexible membrane having a periphery connected to the wall, d. the foundation having floor area below the membrane and within said peripheral wall, e. said membrane being supported at an approximate desired membrane height above the floor area by fluid exerting internal fluid pressure under the membrane greater than fluid exerting external fluid pressure above the membrane, wherein the improved structure comprises in combination with the above:

f. at least one weight connected to the membrane within the periphery, g. said internal fluid pressure also supporting said weight by the intervening support of the membrane, h. said weight depressing the membrane such that a radius of curvature of the membrane between the periphery and weight is less than the radius of curvature of a fully inflated condition, i. whereby the membrane and weights move up and down from the approximate desired membrane height solely responsive to the changing fluid pressures above and below the membrane, j. said membrane having restraining connection to the peripheral wall only.

2. A membrane covered permanent structure built on ground having a. a peripheral wall connected to b. a foundation on the ground, c. a flexible membrane having a periphery connected to the wall, d. the foundation having floor area below the membrane and within said peripheral wall, e. said membrane being supported at an approximate desired membrane height above the floor area by fluid exerting internal fluid pressure under the membrane greater than fluid exerting external fluid pressure above the membrane, wherein the improved structure comprises in combination with the above:

f. at least one weight connected to the membrane within the periphery, said internal fluid pressure also supporting said weight by the intervening support of the membrane, h. said weight depressing the membrane such that a radius of curvature of the membrane between the periphery and the weight is less than the radius of curvature of a fully inflated condition, i. said weight depressing the membrane so that the distant from the top of said wall to the approximate membrane height is less than the height of said wall, j. whereby the membrane moves up and down rom the approximate desired membrane height solely responsive to the fluid pressures above and below the membrane, and restrained only by the membrane connected to said wall and said weight, said membrane having restraining connection to the peripheral wall only.

3. The invention as defined in claim 1 further comprising:

i. said weight depressing the membrane so that an angle formed by the membrane and the wall results in the force of the internal fluid pressure against the wall resulting at the top of said wall to be substantially equal to the horizontal component of the force exerted by said membrane at the top of said wall.

4. A membrane covered permanent structure built on ground having a. a peripheral wall connected to b. a foundation on the ground, c. a flexible membrane having a periphery connected to the wall, d. the foundation having floor area below the membrane and within said peripheral wall, e. said membrane being supported at an approximate desired membrane height above the floor area by fluid exerting internal fluid pressure under the membrane greater than fluid exerting external fluid pressure above the membrane, wherein the improved structure comprises in combination with the above:

f. a plurality of load areas within the periphery, g. a plurality of weights comprising water filled flexible tubes positionally affixed to the membrane at respective load areas, h. said internal fluid pressure also supporting said weights by the intervening support of the membrane, i. said weights depressing the membrane at the load areas such that a radius of curvature of the membrane between the periphery and one of the load areas and between load areas is less than the radius of curvature of a fully inflated condition, j. whereby the membrane and weights move up and down from the approximate desired membrane height responsive to the changing fluid pressures above and below the membrane, k. tube fill means on the tubes for moving said water into and out of the tubes, and l. dump means attached to said tubes for quickly removing the water from the tubes.

5. A structure involving a body of water, and a bottom of said body of water, an improved structure on said bottom comprising:

a membrane having a periphery covering a portion of said bottom, a seal weight on the periphery of said membrane sealing the membrane to the bottom, fluid beneath the membrane within said periphery, at least one load weight connected to the membrane at a load area thereof inside of the periphery, said fluid beneath the membrane supporting the membrane and the load weight above the bottom, and said load weight depressing the membrane at the load area such that a radius of curvature of the membrane between the periphery and the load area is decreased.

6. The invention as defined in claim 5 with the addition of the following limitations:

a peripheral foundation elevated above the bottom, and positioned below the seal weight, said seal weight including a flexible tube, a flexible tube affixed to the membrane at each load area flowable matter in the flexible tubes forming said load weight and said seal weight aid flowable matter being of greater density than the water above the membrane, tube fill means attached to the tubes for moving said flowable matter into and out of said tubes.

* * * * *